US005306686A

United States Patent [19]

Patel et al.

[11] Patent Number: 5,306,686

[45] Date of Patent: Apr. 26, 1994

[54] NEGATIVE-ACTING THERMOGRAPHIC MATERIALS

[75] Inventors: Ranjan C. Patel, Little Hallingbury; John H. A. Stibbard, Harlow; Darren Cooper, Andover; Terence W. Baldock, Harlow, all of Great Britain; Donald J. Newman, White Bear Lake; John J. Stofko, St. Paul, both of Minn.

[73] Assignee: Minnesota Mining and Manufacturing Company, St. Paul, Minn.

[21] Appl. No.: 878,165

[22] Filed: May 4, 1992

[30] Foreign Application Priority Data

May 8, 1991 [GB] United Kingdom ..... 9109948

[51] Int. Cl.[5] ..... B41M 5/28

[52] U.S. Cl. ..... 503/200; 503/201; 503/202; 503/205; 503/226

[58] Field of Search ..... 503/205, 217, 200, 226, 503/201, 202

[56] References Cited

U.S. PATENT DOCUMENTS

| | | | |
|---|---|---|---|
| 3,684,552 | 8/1972 | Wiese et al. | 503/208 |
| 4,620,204 | 10/1986 | Inaba et al. | 503/208 |
| 4,620,205 | 10/1986 | Iiyama et al. | 503/208 |
| 4,665,410 | 5/1987 | Iiyama et al. | 503/208 |

FOREIGN PATENT DOCUMENTS

| | | | |
|---|---|---|---|
| 0403157A3 | 12/1990 | European Pat. Off. | 503/200 |
| 2355184 | 5/1974 | Fed. Rep. of Germany | 503/200 |
| 151392 | 9/1982 | Japan | 503/226 |
| 222882 | 12/1983 | Japan | 503/226 |
| 115891 | 7/1984 | Japan | 503/226 |
| 2150702A | 7/1985 | United Kingdom | 503/200 |
| 2162651A | 2/1986 | United Kingdom | 503/200 |

OTHER PUBLICATIONS

"Heat Sensitive Copying Material", Research Disclosure, Nov. 1975 1st page of the Disclosure Only.

*Primary Examiner*—Pamela R. Schwartz

*Attorney, Agent, or Firm*—Gary L. Griswold; Walter N. Kirn; Mark A. Litman

[57] ABSTRACT

A negative-acting, photothermographic material having a first layer comprising an amine compound and a second layer comprising an amine-reactive dye which undergoes a visible change when in reactive association with the amine compound. The amine compound and the amine-sensitive dye are in non-reactive association at ambient and moderate temperatures, but at elevated temperatures the two components are able to interact to produce a visible change in the heated areas of the material. The materials are particularly suitable for the preparation of overhead projector transparencies.

21 Claims, No Drawings

NEGATIVE-ACTING THERMOGRAPHIC MATERIALS

FIELD OF THE INVENTION

This invention relates to thermographic materials and in particular to negative-acting thermographic media suitable for the preparation of overhead projector transparencies.

BACKGROUND OF THE INVENTION

Overhead projectors (OHP) are routinely used for the display of text and graphic information contained on a transparency sheet. The transparency sheet is placed on an illuminated stage of the OHP, and the transmitted light collected by suitable optics and projected onto a wall or screen. The transparency images are normally prepared by a thermographic process from originals comprising an infrared-absorbing image, e.g., an ink image or electrostatic toner image containing carbon, on a white background. A translucent substrate bearing a thermosensitive coating is placed in face-to-face contact with the original. Thereafter, illumination with infrared radiation generates heat in the toner image, which in turn records the image on the thermosensitive coating. The thermographic process is usually colour-forming, e.g., a positive, dark-on-light image is recorded. There is a continuing need for single-sheet colour-bleaching materials capable of generating negative images, preferably involving a variety of bright colours, with good resolution and with good pre- and post-imaging stability. Many of the negative-acting systems currently available are of the two-sheet type, in which dye and bleaching agent are coated on separate sheets to preserve shelf-stability. Such materials are less convenient, in both use and manufacture, than single-sheet constructions.

Various single-sheet thermal-dye-bleach constructions are known, notably bleachable antihalation layers for photothermographic elements. Such materials are rarely suitable for OHP transparencies, because the demands made on materials for OHP systems are much more severe. For example, in the unbleached state, the transmission optical density (0.D.) at the wavelength of maximum absorption should be at least 1.0, preferably at least 1.5. Substantially all of this absorption must be discharged by a brief, typically less than 1 second, treatment at moderately elevated temperatures. Longer exposures are unacceptable to the customer, and higher temperatures cause vesiculation of the base (and hence light-scattering and image darkening), unless expensive heat-resistant base is used. Not only must the unbleached colour remain stable under normal storage conditions prior to imaging, but it must also survive prolonged exposure on the OHP subsequent to imaging. This contrasts with the 'typical' antihalation layer, where an O.D. of greater than 0.4 is uncommon, heating times of greater than 10 seconds are usual, and bleaching is carried out uniformly rather than image-wise, such that resolution and post-exposure stability are not critical.

U.S. Pat. No. 3,684,552 discloses negative-acting, coloured sheet materials comprising a carrier sheet bearing a heat-sensitive medium comprising an amine-sensitive, coloured dye and a thermal-amine-releaser dissolved in binder. When subjected to imagewise heating, the thermal-amine-releaser decomposes in the heated areas of the material to release an amine compound which reacts with and bleaches the dye, causing a loss or change in colour in those areas. Although the materials are described as being suitable for OHP transparencies, in practice they do not provide an adequate combination of stability and sensitivity.

British Patent Publication No. 2202958 discloses negative-acting, coloured sheet materials comprising a carrier sheet bearing a heat-sensitive medium comprising a coloured dye and a plurality of microcapsules containing a decolourising agent capable of reacting with and bleaching the dye. Imagewise heating causes the microcapsules to rupture or become more permeable in the heated areas of the material, thereby releasing the decolourising agent into the medium to bleach the dye in those areas. Both amines and quaternary amine salts are disclosed as decolourising agents, but only as one of many alternatives, and neither is preferred. The materials are described as being suitable for use as OHP transparencies, but they have the problem of matching the refractive index of the capsules to that of the continuous phase in order to achieve transparency. There are no details of pre- or post-imaging stability.

Japanese Patent Application No. 63-176171 discloses negative-acting OHP sheet materials where the bleaching agent is supplied via a special pen. Such materials cannot be used with conventional transparency imagers.

British Patent Nos. 2150702 and 2173012, and U.S. Pat. Nos. 4,620,204, 4,620,205 and 4,665,410 disclose positive-acting sheet materials capable of forming two different colours when heated at different temperatures. The materials comprise a carrier sheet bearing a heat-sensitive medium containing two dye-precursors, one precursor forming a first coloured dye when heated to a pre-determined temperature and the other a second, different coloured dye when heated to a pre-determined higher temperature. The dye-precursors may be contained in a single layer or two separate layers, with one precursor in each layer. A decolourising agent specific for the first coloured dye is contained in a separate layer adjacent that containing the low-temperature dye-precursor, although where the two dye-precursors are contained in different layers, the decolourising agent may alternatively be contained in the layer containing the high-temperature dye-precursor. An intermediate layer is optionally interposed between the layer containing the decolourising agent and that containing the low-temperature dye-precursor to prevent the migration of the decolourising agent from the former into the latter until the material is heated at the higher temperature.

When imagewise heated at the lower temperature, only the first colour is generated in the heated areas of the material. When heated at the higher temperature, the second colour is also generated in the heated areas of the material, but the decolourising agent migrates across the barrier layer to bleach the first coloured dye.

These materials are primarily intended for use as thermo-sensitive papers, e.g., for facsimile, telex and other information transmission apparatus, and there is no reference to the use of these materials as overhead projector transparencies. The only carrier sheets exemplified in the Examples are "high quality papers".

A wide variety of bleaching agents are disclosed, including both aromatic and aliphatic amines, but the greatest emphasis is placed on polyfunctional amides, generally of high molecular weight, and morpholine and guanidine derivatives. The use of amines is actually discouraged in British Patent No. 2173012. Where the use of amines is taught (e.g., British Patent No. 2150702), solids with a melting point of at least 45° C. are specified. Moreover, while the use of an opaque paper base permits higher imaging temperatures to be tolerated, it effectively precludes application of these materials to OHP systems. The requirement for post-imaging stability is also much less stringent in such materials.

U.S. Pat. No. 3,916,068 discloses heat-sensitive, positive-acting sheet materials comprising a carrier sheet bearing a heat-sensitive medium containing one or two colour-forming "chromagens" and associated colour developers. The heat-sensitive medium either contains two different colour-forming chromagens in a single layer or either the same or a different chromagen in each of two separate layers. An organic amine derivative which is capable of bleaching the chromagen or one of the chromagens is contained in a separate layer adjacent that containing the amine-sensitive chromagen, although, where the chromagen(s) is/are contained in separate layers, the amine may alternatively be contained in one of the chromagen-containing layers.

When the material is heated to a pre-determined temperature, the chromagen(s) and colour developer react to form a coloured image, but when heated to a predetermined higher temperature, then the amine reacts with the chromagen in the heated regions of the material to bleach the developed colour. In the case where two chromagens are present, one chromagen may generate a first colour at the lower temperature with the second chromagen generating a second, different colour at the higher temperature.

Reference is made to the use of a barrier layer to separate two colour-forming layers, but only to prevent the amine from diffusing into the other chromagen-containing layer, i.e., it is not intended to be selectively permeable when heated.

There is no reference to the use of these materials to form overhead projector transparencies. The only support materials described in the Examples are "ordinary papers".

SUMMARY OF THE INVENTION

There has now been found a thermal-dye-bleach construction comprising an amine and an amine-sensitive dye suitable for the preparation of negative-acting thermographic media.

According to one aspect of the present invention there is provided a negative-acting thermographic material having a first layer comprising an amine compound having one or more amino groups and a second layer comprising an amine-sensitive dye which undergoes a visible change when in reactive association with the amine compound.

According to another aspect of the invention there is provided a method of producing an image comprising:

(i) providing a negative-acting, thermographic material of the invention, and (ii) image-wise exposing the material to infrared radiation.

The thermographic materials of the invention have an image-forming medium consisting essentially of an amine compound and an amine-sensitive dye. The interaction of the amine compound and amine-sensitive dye "bleaches" the latter to allow for the formation of a negative (light-on-dark) image. Bleaching in this context means a diminution or reduction in image density at one of the longest wavelength absorption peaks of the dye, possibly (although not necessarily) with a concomitant increase in absorption at shorter wavelengths to produce a loss or change in colour in the regions exposed to elevated temperatures.

The thermographic materials of the invention do not require the presence of components which together generate a colour or colour change providing an increase in absorption at longer wavelengths.

The amine-sensitive dye is ordinarily present in an amount sufficient to provide a transmission optical density of at least 1.0, preferably at least 1.5 at the wavelength of maximum absorption.

The thermographic materials of the invention are especially suitable for the preparation of overhead projector transparencies, and according to a further aspect of the invention there is provided an overhead projector transparency comprising an imagewise heated thermographic material of the invention.

The present invention provides thermographic materials which are constructed and arranged such that the amine compound and the amine-sensitive dye are in non-reactive association at ambient and moderate temperatures but at elevated temperatures, generally greater than 100° C. and usually above 150° C., the two components are able to interact, typically within a few seconds, to produce a visible change in the imaged (heated) areas of the material. This may be achieved in a number of ways, e.g., by including a barrier layer between the first and second layers which allows migration of the amine compound and/or amine-sensitive dye into the opposing layer at higher temperatures or alternatively by immobilising one or both components in their respective layer until imaging. In a preferred embodiment of the invention, a barrier layer is interposed between the first and second layer which is substantially impermeable to the amine compound and amine-sensitive dye at ambient temperature but allows migration of the amine compound and/or the amine-sensitive dye through the layer above a predetermined elevated temperature.

DETAILED DESCRIPTION OF INVENTION

The thermographic materials of the invention consist essentially of a layer of an amine compound and a layer of an amine-sensitive dye optionally separated by a barrier layer. The barrier layer (when present) is substantially impermeable to both the amine compound and the amine-sensitive dye at temperatures below a predetermined threshold temperature, while allowing migration of the amine and/or dye across the barrier layer at elevated temperatures. The barrier layer is required when the amine compound shows substantial interlayer mobility at ambient or moderately-elevated temperatures, as is normally the case when the amine has a relatively low molecular weight, e.g., less than 2000. However, if the amine compound is a polymer, or is otherwise rendered substantially immobile at ambient and moderately elevated temperatures, then the barrier layer may be omitted.

In a preferred embodiment, the thermographic materials of the invention comprise a support having coated thereon, in order of deposition, a first binder layer containing the amine compound, a barrier layer and a second binder layer containing the amine-sensitive dye. Alternatively, the first and second binder layers may be reversed.

The support may comprise any suitable material known in the art, but for the preparation of OHP transparencies the support preferably comprises a transparent and flexible material that does not distort or decompose on passage through a conventional transparency imager or upon prolonged display on the illuminated stage of an OHP. A preferred material is biaxially oriented polyester film. The support has a typical thickness in the range from 50 to 200 μm.

The first and second binder layers may comprise any suitable binder known in the art, although in the embodiment comprising a barrier layer, solvent-soluble thermoplastic polymers, especially vinyl polymers, such as poly(vinyl formal), poly(vinyl butyral), copolymers of poly (vinylidene chloride-vinyl acetate) (VYNS), e.g., VAGH (a hydroxyl-modified vinyl chloride-vinyl acetate copolymer having a composition of approximately 90% vinyl chloride, 42% vinyl acetate with a hydroxyl content of approximately 2.3%, supplied by Union Carbide) or a combination thereof, are preferred. The binder of the amine-containing layer is preferably BUTVAR B72a (poly(vinyl butyral), commercially available from Monsanto). The binder of the dye-containing layer is preferably FORMVAR 12/85 (poly(vinyl formal), commercially available from Monsanto).

In the embodiment not comprising a barrier layer, the binders and coating solvents are chosen so that one layer may be coated on top of the other with minimal swelling of the bottom layer and premature mixing of reactants. Preferably the binder of the dye-containing layer is selected from the solvent-soluble thermoplastics described above and the binder for the amine-containing layer selected from water soluble polymers such as hydroxyethylcellulose or poly(vinyl alcohol). If the amine compound is itself a film-forming polymer, an additional binder for this layer may not be necessary.

In the embodiment comprising a barrier layer, the amine compound may comprise any suitable compound having one or more amino groups which combines the properties of stability, i.e., containment in the first binder layer at ambient and moderately-elevated temperatures, and reactivity, i.e., the ability to migrate into and across the barrier layer at higher temperatures. This is governed to some extent by the thickness and composition of the various layers but also by the structure and size of the amine compound itself. The amine compound preferably comprises one or more primary or secondary aliphatic amines and more preferably one or more primary or secondary aliphatic amines having a molecular weight in the range from 100 to 500. In a most preferred embodiment the amines comprise primary or secondary linear aliphatic amines. Suitable amines are typically liquid at room temperature.

One particularly preferred class of amine compounds has a nucleus of general formula (I):

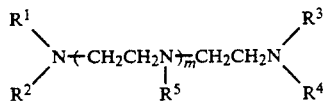

(I)

in which:

$R^1$ to $R^5$ independently represent a hydrogen atom or an alkyl group comprising up to 10, more preferably 5 carbon atoms which may optionally possess one or more substituents selected from OH, —CN, —OR, —SR, —O—C(=O)—R and —C(=O)—OR, where R is an alkyl group comprising up to 5 carbon atoms, with the proviso that at least one of $R^1$ to $R^5$ represents a hydrogen atom, and m has integral values of from 1 to 5. Preferably, each of $R^1$ to $R^5$ represents a hydrogen atom and m has a value of 2 or 3. A preferred amine compound is tetraethylenepentamine.

The quantity of amine compound present in the first binder layer varies with the properties of the barrier layer and the nature of the amine-sensitive dye. Generally, the amine compound is present in an amount in the range from 5 to 50, preferably 7.5 to 30% by weight of the amine-containing layer. The amine-containing layer typically has a dry coating thickness of from 1 to 5 μm.

In the embodiment not comprising a barrier layer, the amine compound is preferably a polymer comprising a plurality of primary and/or secondary amino groups, with a molecular weight greater than 2,000, preferably greater than 10,000. Examples of such materials include poly(vinyl amine) and poly(allyl amine), but a particularly suitable material is poly(ethyleneimine) with an average molecular weight in the range $4.0\times10^4$ to $10.0\times10^4$. Film-forming polymeric amines may be used in the absence of additional binders. A preferred construction comprises a blend of poly(ethyleneimine) with a water-soluble binder such as poly(vinyl alcohol), hydroxyethylcellulose, gelatin, poly(vinylpyrrolidone), poly(acrylamide), poly(isopropylacrylamide), butyl methacrylate graft on gelatine, ethyl acrylate graft on gelatin, ethyl methacrylate graft on gelatin, cellulose monoacetate, methyl cellulose, or a blend thereof. In a most preferred construction the amine-containing layer comprises poly(ethyleneimine) in a blend with hydroxyethylcellulose (at a weight ratio of 1:0.5 to 1:4, preferably 1:1).

The barrier layer is designed to keep the amine and the amine-sensitive dye separate at temperatures below a predetermined threshold temperature, and to allow their migration and subsequent reaction at temperatures higher than the threshold temperature. The barrier layer may comprise poly(vinyl alcohol), gelatin, poly(vinylpyrrolidone), poly(acrylamide), poly(isopropylacrylamide), butyl methacrylate graft on gelatin, ethyl acrylate graft on gelatin, ethyl methacrylate graft on gelatin, cellulose monoacetate, methyl cellulose, poly(acrylic acid) or a blend thereof. In a most preferred embodiment, the barrier layer comprises a homoplymer or a copolymer of poly(vinyl alcohol), e.g., a copolymer of poly(vinyl alcohol) and poly(vinyl acetate) or a blend of poly(vinyl alcohol) and poly(acrylic acid). Generally the barrier layer comprises PVA resulting from at least 50% hydrolysis, typically about 98% hydrolysis of the precursor poly(vinyl acetate). The molecular weight of the PVA is also found to influence its barrier properties so that it is preferred to use PVA having a molecular weight in the range from 70,000 to 150,000, with a typical value of about 126,000. Blends of both high and low molecular weight materials are particularly useful, e.g., a blend of 72,000 and 124,000 PVA. The barrier properties of the barrier layer may also be modified by the inclusion of one or more low molecular weight additives, such as urea or an alkyl or dialkyl derivative thereof, into the pre-coating mix.

Such materials may comprise up to 60% by weight of the barrier layer, and generally have the effect of increasing the permeability towards both the amine compound and the amine-sensitive dye at higher temperatures. The dry coated thickness of the barrier layer is typically from 0.1 to 2.0 μm.

A wide variety of dyes are known in the art to be amine-bleachable, including triarylmethane, styryl, benzylidene, indophenol, polymethine, e.g., merocyanine dyes, and azine dyes, although not necessarily all members of these classes are bleachable. Dyes suitable for use in the invention may be identified by treating a solution of the dye, e.g., in acetone, with at least an equivalent quantity of an amine of the general formula (I), and warming gently. Suitable dyes show a rapid discharge, or change of colour, while unsuitable dyes do not.

The selection of suitable dyes depends on a number of factors, including the desired hue and change thereof, and the rate of bleaching and stability, especially their stability to prolonged white light exposure. It has been found that the rate of bleaching can be enhanced if the dyes themselves have some thermal mobility, i.e., they are capable of migrating into and across the barrier layer and/or amine-containing layer at the imaging temperature. This allows for the use of less mobile amine compounds, which is found to increase the shelf-life of the product. Indeed, in embodiments in which the amine compound is a polymer, it is believed that the bulk of the bleaching action arises from migration of the dye(s).

Thermal migration of prospective dyes can be tested by coating successive layers onto a transparent substrate in accordance with the invention but omitting the amine compound and subjecting the construction to heat treatment, e.g., 125° C. for 10 seconds. By measuring the absorbance before and after washing off the layers sequentially with appropriate solvents, it is possible to estimate the relative amounts of dye in each layer. After the above treatment, with certain dyes it is found that some 40% of dye can have migrated from the dye-containing layer to what is normally the amine-containing layer, especially when urea or an alkyl or dialkyl derivative thereof is included in the barrier layer.

Thermally mobile dyes are well-known from the fields of thermal printing and photothermographic media, and dyes useful in these fields are also useful in the present invention, provided they are amine-bleachable. Generally, thermal mobility is favoured by a low molecular weight, the absence of ionic charge and the absence of bulky substituents. Thus, selected tricyanovinyl, benzylidene and merocyanine dyes, for example, have been found to be particularly useful. Thermal mobility, assessed as above, has been found to correlate well with imaging speed, and it is believed that thermal mobility on the part of both the amine-sensitive dye and the amine compound is important in achieving the desired combination of imaging speed and shelf-stability. Preferred dyes include those having a nucleus of general formula (II) to (V):

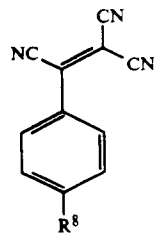
(II)

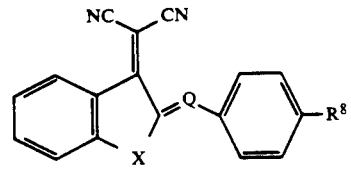
(III)

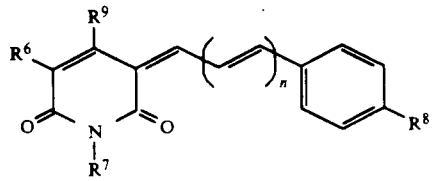
(IV)

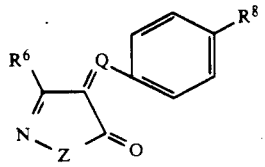
(V)

in which;

n is 0 or 1;

Q represents CH or N;

$R^6$ represents $$-\overset{O}{\overset{\|}{C}}-OR^7, \quad -SO_2R^7$$

or an aryl group comprising up to 14, preferably up to 10 carbon atoms, each of which groups may optionally possess one or more substituents selected from neutral and electron withdrawing groups, or $R^6$ may represent a cyano group;

$R^7$ represents an alkyl group comprising up to 10, preferably up to 5 carbon atoms, or an aryl group comprising up to 14, preferably up to 10 carbon atoms, each of which groups may optionally possess one or more substituents selected from neutral, electron-releasing and electron-withdrawing groups;

$R^8$ represents an alkoxy group comprising up to 10, preferably up to 5 carbon atoms, a dialkylamino group comprising up to 10, preferably up to 5 carbon atoms, or the necessary non-metallic atoms to complete a heterocyclic fused ring nucleus incorporating at least two carbon atoms of the phenyl group on which $R^8$ is attached and comprising up to 10 ring atoms in toto, each of which groups and fused ring nuclei may optionally possess one or more substituents selected from neutral, electron-releasing and electron-withdrawing groups;

$R^9$ represents an alkyl group comprising up to 5 carbon atoms, each of which may optionally possess one or more substituents selected from neutral, electron-releasing and electron-withdrawing groups;

X represents $SO_2$, C=O or 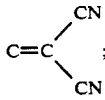 ; and

Z represents O, S or $NR^{10}$, where $R^{10}$ represents an alkyl group comprising up to 10, preferably up to 5 carbon atoms or an aryl group comprising up to 14, preferably up to 10 carbon atoms, each of which groups may optionally possess one or more substituents selected from neutral, electron-releasing and electron-withdrawing groups.

In the above context, "neutral groups" include halogen atoms (such as Cl, Br etc.), alkyl groups comprising up to 5 carbon atoms (such as methyl, ethyl etc.), aryl groups comprising up to 10 carbon atoms (such as phenyl, naphthyl etc.), aralkyl groups (such as benzyl etc.) and alkaryl groups (such as toluyl etc.); "electron-withdrawing groups" include nitro, cyano, sulphonyl, formyl, ketone, ester, amide, carboxyl and trifluoromethyl groups and "electron-releasing groups" include hydroxyl, ether, thiol, thioether and tertiary amino groups.

Examples of preferred dyes include:

1 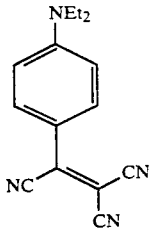

2 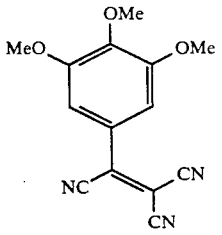

3 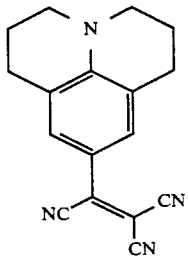

4 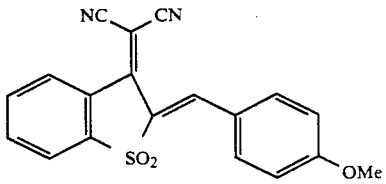

-continued

5 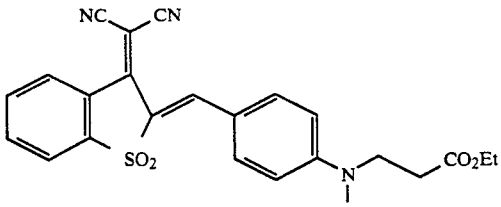

6 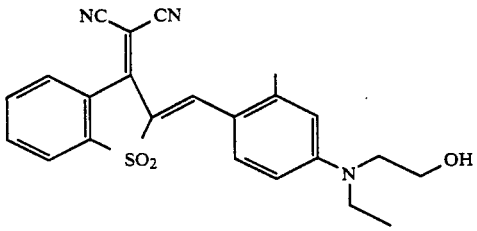

7 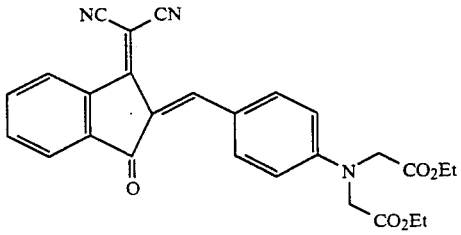

8 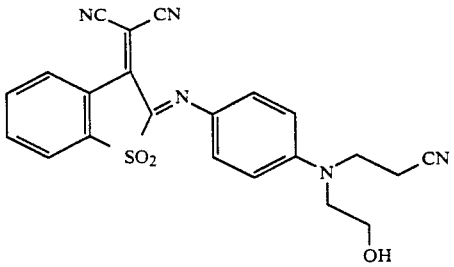

9 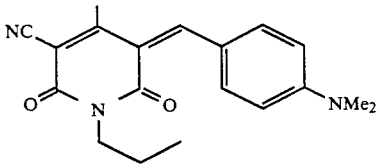

10 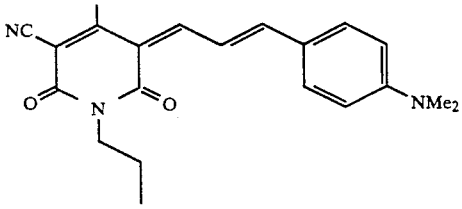

11 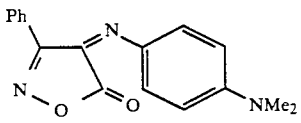

-continued

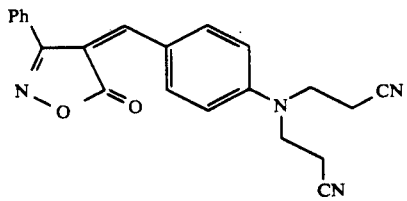

Another class of preferred dyes has a nucleus of general formula (VI):

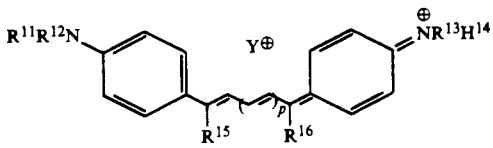

(VI)

in which:

p is 0 or an integer from 1 to 3, $R^{11}$ to $R^{14}$ independently represent hydrogen atoms, optionally substituted alkyl groups comprising up to 30 carbon atoms, optionally substituted alkenyl groups comprising up to 30 carbon atoms or optionally substituted aryl groups comprising up to 14 carbon atoms; or $R^{11}$ and $R^{12}$ together and/or $R^{13}$ and $R^{14}$ together may represent the necessary atoms to complete a 5 or 6-membered optionally substituted heterocyclic ring, or one or more of $R^{11}$ to $R^{14}$ may represent the necessary atoms to complete an optionally substituted 5 or 6-membered heterocyclic ring fused to the phenyl ring on which the $NR^{11}R^{12}$ or $NR^{13}R^{14}$ group is attached;

$R^{15}$ and $R^{16}$ independently represent hydrogen atoms, tertiary amino groups, optionally substituted alkyl groups comprising up to 10 carbon atoms, optionally substituted aryl groups comprising up to 10 carbon atoms, optionally substituted heterocyclic ring nuclei comprising up to 6 ring atoms, optionally substituted carbocyclic ring nuclei comprising up to 6 carbon atoms or optionally substituted fused ring systems comprising up to 14 ring atoms, and, $Y^{\ominus}$ is an anion.

In the dyes of general formula (VI), $R^{11}$ to $R^{14}$ are generally selected from hydrogen atoms, optionally substituted alkyl and alkenyl groups comprising up to 30 carbon atoms, usually up to 10 carbon atoms and more often up to 5 carbon atoms and optionally substituted aryl groups comprising up to 14 carbon atoms, but more usually up to 10 carbon atoms.

When groups represented by $R^{11}$ to $R^{16}$ are substituted, the substituents are generally selected from halogen atoms, nitro groups, nitrile groups, hydroxy groups, ether groups comprising up to 5 carbon atoms, ketone groups comprising up to 5 carbon atoms, aldehyde groups, ester groups comprising up to 5 carbon atoms, amide groups comprising up to 5 carbon atoms, alkylthio groups comprising up to 5 carbon atoms, alkoxy groups comprising up to 5 carbon atoms, alkyl groups comprising up to 5 carbon atoms, alkenyl groups comprising up to 5 carbon atoms, aryl groups comprising up to 10 carbon atoms and heterocyclic ring nuclei comprising up to 10 atoms selected from C, N, O, S and Se, and combinations of these substituents.

Generally $R^{11}=R^{12}$ and $R^{13}=R^{14}$. Preferred examples of groups represented by $R^{11}$ to $R^{14}$ are selected from methyl, ethyl and methoxyethyl groups.

In addition, $R^{11}$ and $R^{12}$ together and/or $R^{13}$ and $R^{14}$ together may represent the non-metallic atoms necessary to complete a nucleus of a 5 or 6-membered heterocyclic ring. When completing such a ring, the atoms are generally selected from non-metallic atoms comprising C, N, O, S and Se and each ring may be optionally substituted with one or more substituents as described above. The heterocyclic ring nuclei so completed may be any of those known in polymethine dye art but preferred examples include morpholine and pyrrolidine.

$R^{15}$ and $R^{16}$ are generally selected from hydrogen atoms, tertiary amino groups, optionally substituted alkyl groups comprising up to 10 carbon atoms but more usually up to 5 carbon atoms and aryl groups comprising up to 10 carbon atoms; each of which group may be substituted by one or more substituents as described above and additionally when $R^{15}$ and/or $R^{16}$ represent an aryl group then additional substituents may include $NR^{11}R^{12}$ and $NR^{13}R^{14}$ (in which $R^{11}$ to $R^{14}$ are as defined above). Preferred examples of $R^{15}$ and $R^{16}$ are selected from hydrogen atoms, 4-dimethylaminophenyl, 4-diethylaminophenyl, 4-bis(methoxy ethyl) aminophenyl, 4-N-pyrrolidinophenyl, 4-N-morpholinophenyl or bi-phenyl groups.

$R^{15}$ and $R^{16}$ may also represent a nucleus of a 5 or 6-membered heterocyclic ring, in which ring atoms are selected from C, N, O, S and Se, a 5 or 6-membered carbocyclic ring or a fused ring system comprising up to 14 ring atoms selected from C, N, O, S and Se, wherein each ring may possess one or more substituents as described above. Preferred examples include morpholine and thiophene nuclei.

Suitable anions for $Y^{\ominus}$ include organic anions such as those containing a sulphonyl group as the ionic determinant, for example, trifluoromethanesulphonate and 4-toluene sulphonate.

The length of the polymethine chain is determined by p which has integral values in the range of $0 \leqq p \leqq 3$ completing tri-, penta-, hepta- and nonamethine chain lengths. The polymethine chain may be unsubstituted or contain substituents, for example alkyl groups, generally comprising up to 5 carbon atoms, substituted alkyl groups comprising up to 5 carbon atoms, hydroxyl groups or halogen atoms may be present. The polymethine chain may contain a bridging moiety, for example, those non-metallic atoms necessary to complete a heterocyclic ring or a fused ring system or a carbocyclic ring, each of which may possess alkyl substituents comprising up to 5 carbon atoms. Examples of bridging moieties include cyclohexene and cyclopentene nuclei.

In addition to the ring substituents shown in general formula (VI) of the central dye nucleus, the dyes may possess ring substituents in other positions which are generally selected from the range of substituents suitable for the groups $R^{11}$ to $R^{16}$.

An example of dyes represented by general formula (VI) is:

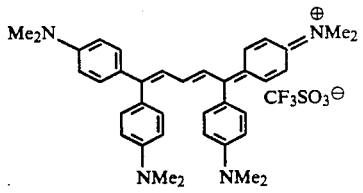

Further preferred dyes include:

13

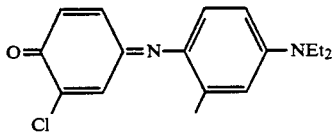

14

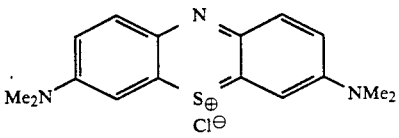

15

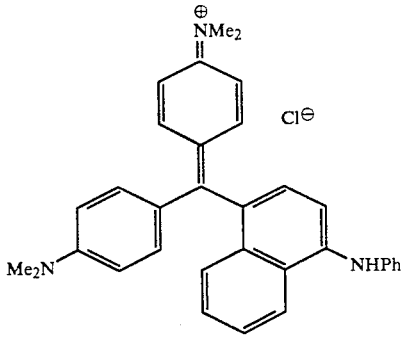

16

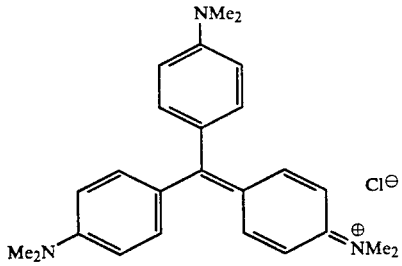

17

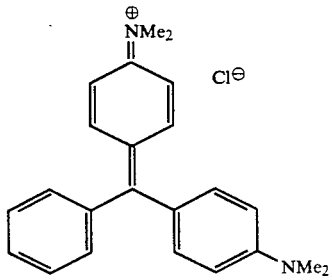

-continued

18

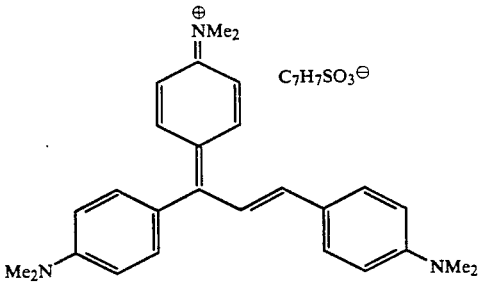

19

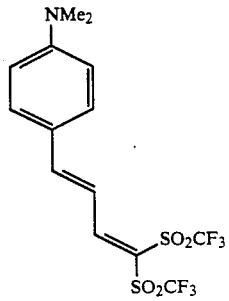

20

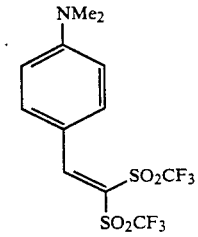

Frequently, two or more dyes will be present in the dye-containing layer, e.g., a mixture of yellow, magenta and cyan dyes can give a black layer, and if all three dyes are bleachable, a white-on-black image can be obtained. Alternatively, if only the cyan and magenta dyes are bleachable, a yellow-on-black image results. It will be readily apparent that a wide variety of colour images can be obtained from suitable combinations of bleachable and non-bleachable dyes.

Typical dry coating thicknesses for the dye-containing layer are in the range 0.5 to 2.5 μm. The amount of amine-sensitive dye present varies with the optical density required and the extinction coefficients of the dyes involved. Typical loadings are in the range 5 to 50, preferably 10 to 40% by weight of the dye-containing layer.

In one preferred embodiment, the thermographic material additionally comprises an overlayer of an anti-stick coating. This may comprise any one of a variety of heat-resistant polymers with release properties, but a preferred material is "SYL-OFF", commercially available from Dow Corning.

Each layer may additionally comprise one or more coating aids, surfactants, etc., known in the art.

The thermographic materials of the invention may be formed by the successive coating of each layer upon a support using conventional techniques known in the art, such as solvent casting etc.

The thermographic materials of the invention may be imaged by any suitable thermal means, but for the preparation of OHP transparencies the materials can conveniently be imaged in a conventional transparency imager, such as the 3M Model 4500 transparency imager commercially available from the Minnesota Mining and Manufacturing Company. This involves placing the material to be imaged in face-to-face assembly with a sheet bearing an infrared-absorbing image to be copied (such as a photocopy or other ink/electrostatic toner image containing carbon), preferably on a white background, so that the coated side of the imaging material is in direct contact with the toner image. The composite of imaging material and image bearing sheet, optionally held under pressure, is then uniformly exposed to infrared radiation. This generates heat in the photocopy toner image which in turn heats the corresponding areas of the imaging material. In these areas the barrier layer loses its barrier properties, allowing the dye and amine to come into contact, with concomitant bleaching of the former. On peeling the imaged material from the toner original, a negative image is produced ready for display on an OHP.

The invention will now be described with reference to the following non-limiting Examples.

EXAMPLE 1

This Example describes the preparation and use of a thermographic imaging material in accordance with the invention.

Tetra-ethylenepentamine (0.2 g) was added to 20 g of a 5% w/w solution of BUTVAR B72a in ethanol. The resulting solution was coated onto unsubbed 101 μm polyester base using K-bar 4 and dried for 1 minute at 80° C. On top of this was coated a solution comprising 10 g of a 4% w/w aqueous solution of PVA (m.w. = 126,000; 98% hydrolysed) and 3 drops of TERGITOL TMN-10 (10% solution in water) using K-bar 3. This coating was dried for 90 seconds at 80° C. On top of this was coated a solution of Dye No. 1 (0.2 g), FORMVAR 12/85 (1.0 g), tetrahydrofuran (1 g) and dichloromethane (18 g) usinq K-bar 3, followed by drying for 1 minute at 35° C. Dye No. 1 has the following structure:

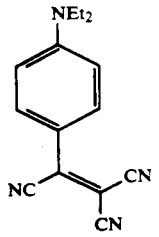

Finally, an anti-stick coating of SYL-OFF was added by mixing a solution of C4-2117 (0.14 g), methyl ethyl ketone (MEK) (1.5 g) and heptane (11.5 g) with a solution of 297 (0.05 g), XY176 (0.13 g) and heptane (14.8 g), and coating immediately using K-bar 3. "C4-2117", "297" and "X176" are the individual ingredients of the SYL-OFF coating formulation as supplied by Dow Corning. The coating was dried for 1 minute at 50° C.

The resulting thermographic imaging sheet was placed in face-to-face contact with a photocopied image and passed through a Model 4500 transparency maker, commercially available from Minnesota Mining and Manufacturing Company, to give a sharp, colourless image on a magenta background, suitable for projection.

A sample of the unimaged thermographic material was stored at 50° C. and ambient room temperature for 18 days, during which the maximum absorbance fell from 2.4 to 2.2.

A further sample was exposed for 10 hours on an OHP, during which the maximum absorbance fell from 2.6 to 2.2.

The above tests suggest that the thermographic materials of the invention have a good stability towards unwanted bleaching.

EXAMPLE 2

The procedure of Example 1 was repeated to prepare further thermographic sheets in accordance with the invention incorporating a variety of amine-sensitive dyes. Table 1 presented below records the dye structures, the unbleached absorption wavelength (or colour) and the colour of the bleached image. Dye Nos. 6 and 14 to 17 are commercially available samples of FORON BLUE, METHYLENE BLUE, SS VICTORIA BLUE, CRYSTAL VIOLET and MALACHITE GREEN respectively, with the remainder synthesised by conventional procedures known in the art.

TABLE 1

| Dye No | Dye Structure | λ max | Bleach Colour |
|---|---|---|---|
| 2 | 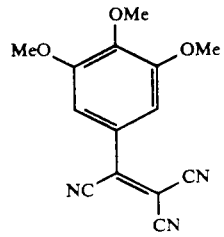  | 418 nm | Colourless |

TABLE 1-continued
| Dye No | Dye Structure | λ max | Bleach Colour |
|---|---|---|---|
| 3 | 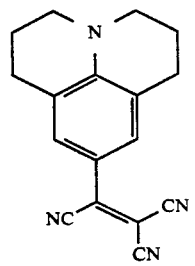 | 558 nm | Colourless |
| 4 | 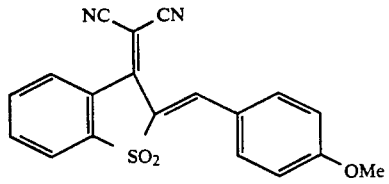 | 428 nm | Pale Yellow |
| 5 | 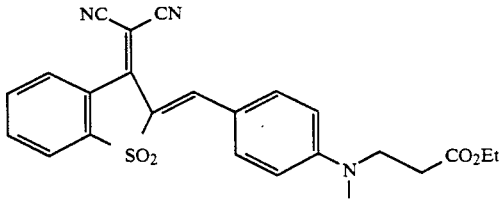 | 558 nm | Pale Yellow |
| 6 | 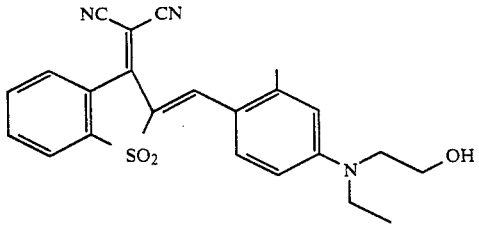 | 599 nm | Pale Yellow |
| 7 | 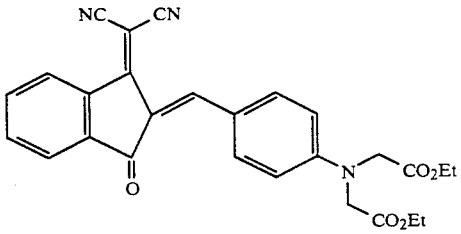 | 516 nm | Orange/Red |
| 8 | 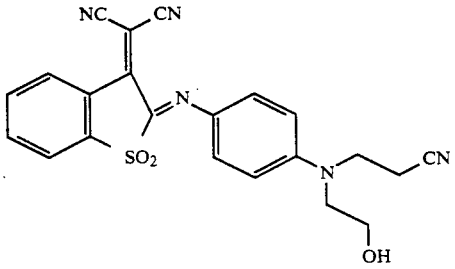 | 605 nm | Colourless |
| 9 | 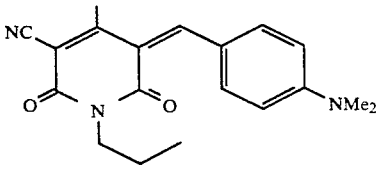 | 523 nm | Colourless |

TABLE 1-continued
| Dye No | Dye Structure | λ max | Bleach Colour |
|---|---|---|---|
| 10 | 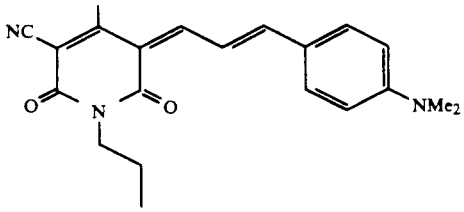 | Blue | Colourless |
| 11 | 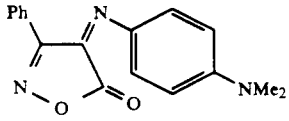 | 527 nm | Yellow |
| 12 | 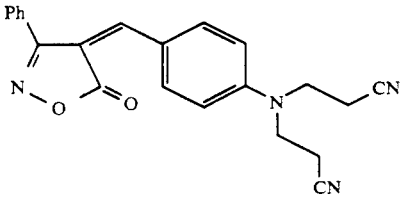 | Yellow | Colourless |
| 13 | 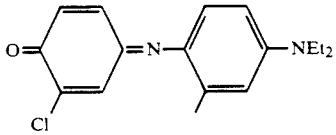 | 641 nm | Colourless |
| 14 | 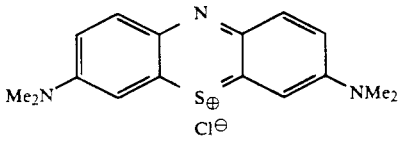 | 658 nm | Colourless |
| 15 | 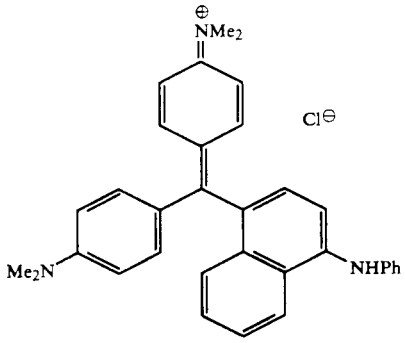 | 599 nm | Orange |
| 16 | 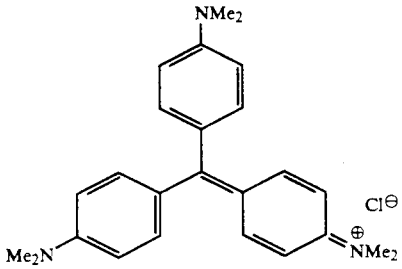 | 601 nm | Colourless |

TABLE 1-continued

| Dye No | Dye Structure | λ max | Bleach Colour |
|---|---|---|---|
| 17 | 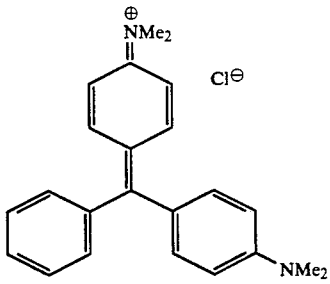 | 615 nm<br>418 nm | Colourless |
| 18 | 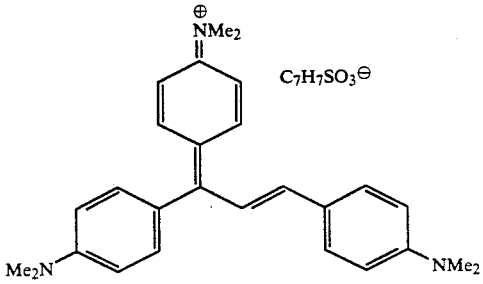 | 695 nm | Colourless |
| 19 | 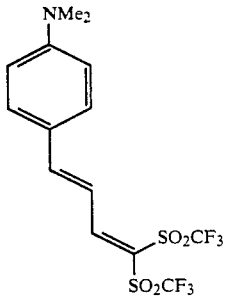 | Blue | Colourless |
| 20 | 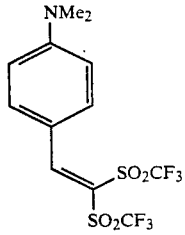 | Yellow | Colourless |
| 21 | 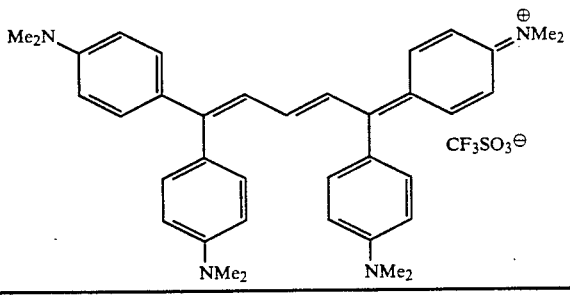 | Blue | Colourless |

EXAMPLE 3

This Example demonstrates the thermal mobility of some of the dyes used in the thermographic imaging materials of the invention, and also the increased permeability of PVA in the presence of urea derivatives.

A first series of photothermographic sheets were prepared as detailed in Example 1 but omitting the tetra-ethylenepentamine from the first layer, varying the identity of the dye and using a 1:1 blend of both high and low molecular weight PVA in the interlayer (m.w. = 124,000 and 72,000). A second series of sheets were made identical to the first except that ethyl urea was added to the interlayer (0.3 g ethyl urea per 10 g coating solution).

Samples of the first and second sheets were heated for 10 seconds at 125° C. and the absorbance measured both before and after Washing with MEK (to remove the anti-stick coating and dye-containing layer) and with water (to remove the PVA layer). The proportions of dye present in the first layer was then estimated with the results presented below in Table 2.

These results indicate that the permeability of the PVA barrier layer to the amine-sensitive dye is increased by the presence of ethyl urea in the barrier layer

TABLE 2

| Dye No. | Ethyl Urea Present | % dye in first layer following exposure |
|---|---|---|
| 1 | No | 0.3 |
| | Yes | 28 |
| 6 | No | 0 |
| | Yes | 33 |
| 9 | No | 4.5 |
| | Yes | 28 |
| 10 | No | 0 |
| | Yes | 33 |
| 12 | No | 0 |
| | Yes | 6 |

EXAMPLE 4

This Example describes thermographic materials prepared in accordance with the invention in which there is no barrier layer. The coating methods of Example 1 were followed, omitting the PVA and SYL-OFF layers. The amine layer comprised a 1:1 w/w blend of NATROSOL 250L hydroxyethylcellulose (commercially available from Hercules) and EPOMIN P-1000 polyethyleneimine (molecular weight $=7\times10^4$ commercially available as an aqueous solution from Aceto Chemical Co.) and was coated using a number 16 Meier coating rod. The solids of the dye-containing layer comprised resin (0.5 parts), Dye No. 19 (0.06 parts) and Dye No. 20 (0.03 parts)(all parts by weight), the resin being selected from FORMVAR (as in Example 1) and VINYLITE VYHH (a copolymer of vinyl chloride and vinyl acetate, commercially available from Union Carbide).

The optical density of samples of these coatings were recorded before and after 5 seconds contact with a thermal block maintained at 130° C., giving the following results:

TABLE 3

| Resin in Dye Layer | Optical Density Before | Optical Density After |
|---|---|---|
| FORMVAR | 2.03 | 0.73 |
| VINYLITE VYHH | 1.14 | 0.06 |

"SYL-OFF", "C4-2117", "297" and "XY176" (Dow Corning), "NATROSOL" (Hercules), "EPOMIN P-1000" (Aceto Chemical Co.), "VINYLITE VYHH" (Union Carbide), "FORON BLUE", "METHYLENE BLUE", "SS VICTORIA BLUE", "CRYSTAL VIOLET", "MALACHITE GREEN", "TERGITOL TMN-10", "BUTVAR B72a" (Monsanto), "FORMVAR 12/85" are all trade names/designations.

What we claim:

1. A negative-acting thermographic material having a first layer comprising an amine compound having one or more amino groups and a second layer comprising an amine-sensitive dye which undergoes a visible change when in reactive association with the amine compound wherein a barrier layer is interposed between said first and second layers, which barrier layer is substantially impermeable to the amine compound and amine-sensitive dye at ambient temperature but allows migration of the amine compound and/or the amine-sensitive dye through the layer above a predetermined elevated temperature.

2. The thermographic material according to claim 1 wherein the amine compound is selected from the group consisting of primary and secondary aliphatic amines having a molecular weight not greater than 2000.

3. The thermographic material according to claim 2 wherein the primary and secondary aliphatic amines have a molecular weight in the range from 100 to 500.

4. The thermographic material according to claim 2 wherein the amine compound has a nucleus of general formula (I):

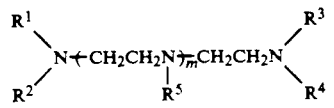

(I)

wherein;

each of $R^1$ to $R^5$ is independently selected from the group consisting of hydrogen, alkyl groups of up to 10 carbon atoms which may possess one or more substituents selected from the group consisting of —OH, $$-CN,\quad -OR,\quad SR,\quad -O-\overset{O}{\overset{\|}{C}}-R \text{ and } -\overset{O}{\overset{\|}{C}}-OR,$$

where R is an alkyl group of up to 5 carbon atoms, with the proviso that at least one of $R^1$ to $R^5$ must be hydrogen, and m has integral values of from 1 to 5.

5. The thermographic material according to claim 4 wherein each of $R^1$ to $R^5$ is hydrogen, and m is 2 or 3.

6. The thermographic material according to claim 1 wherein the barrier layer comprises a polymer selected from the group consisting of poly(vinyl alcohol), gelatin, poly(vinyl pyrrolidone), poly(acrylamide), poly(isopropyl acrylamide), butyl methacrylate graft on gelatin, ethyl acrylate graft on gelatin, ethyl methacrylate graft on gelatin, cellulose monoacetate, methyl cellulose, poly(acrylic acid) and blends thereof.

7. The thermographic material according to claim 6 wherein the barrier layer comprises poly(vinyl alcohol).

8. The thermographic material according to claim 6 wherein the barrier layer additionally comprises up to 60% by weight of an additive selected from the group consisting of urea, alkyl derivatives of urea, and dialkyl derivatives of urea.

9. The thermographic material according to claim 1 wherein the amine compound comprises a polymer having a molecular weight greater than 2000 and a plurality of primary and/or secondary amino groups.

10. The thermographic material according to claim 9 wherein the polymer has a molecular weight greater than 10,000.

11. The thermographic material according to claim 10 wherein the amine compound is selected from the group consisting of poly(vinyl amine), poly(allyl amine) and poly(ethyleneimine).

12. The thermographic material according to claim 1 wherein the amine compound comprises from 5 to 50% by weight of the amine-containing layer.

13. The thermographic material according to claim 1 wherein the amine-sensitive dye is selected from the group consisting of triarylmethane, styryl, benzylidene, indophenol, azine, tricyanovinyl and polymethine dyes.

14. The thermographic material according to claim 13 wherein the amine-sensitive dye has a nucleus of one of the following general formulae (II) to (VI):

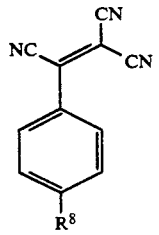
(II)

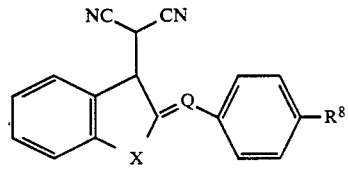
(III)

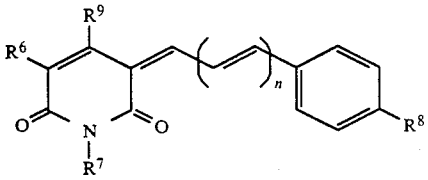
(IV)

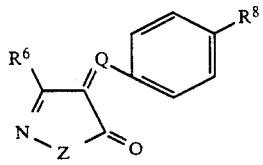
(V)

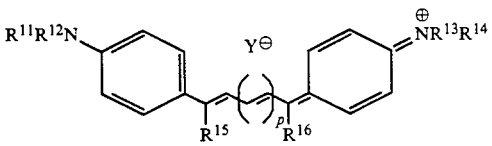
(VI)

wherein:

n is 0 or 1;

p is 0, 1, 2 or 3;

$R^6$ is selected from the group consisting of $$-\overset{O}{\overset{\|}{C}}-OR^7, \quad -SO_2R^7,$$

aryl groups of up to 14 carbon atoms, and cyano groups;

Q is selected from CH or N;

$R^7$ is selected from the group consisting of alkyl groups of up to 10 carbon atoms and aryl groups of up to 14 carbon atoms;

$R^8$ is selected from the group consisting of alkoxy groups of up to 10 carbon atoms, dialkyamino groups of up to 10 carbon atoms, and those non-metallic atoms necessary to complete a heterocyclic fused ring nucleus incorporating at least two carbon atoms of the phenyl radical on which $R^8$ is attached and having up to 10 ring atoms;

$R^9$ represents an alkyl group comprising up to 5 carbon atoms;

each of $R^{11}$ to $R^{14}$ is independently selected from the group consisting of hydrogen, alkyl groups of up to 30 carbon atoms, alkenyl groups of up to 30 carbon atoms, and aryl groups of up to 14 carbon atoms, or $R^{11}$ and $R^{12}$ together and/or $R^{13}$ and $R^{14}$ together may represent the necessary atoms to complete a 5 or 6-membered heterocyclic ring nucleus; or one or more of $R^{11}$ to $R^{14}$ may represent the necessary atoms to complete a 5 or 6-membered heterocyclic nucleus fused to the phenyl ring on which the $NR^{11}R^{12}$ or $NR^{13}R^{14}$ group is attached, each of which groups and fused ring nuclei may possess one or more substituents selected from the group consisting of halogen, nitro groups, nitrile groups, hydroxy groups, ether groups of up to 5 carbon atoms, aldehyde groups of up to 5 carbon atoms, ester groups of up to 5 carbon atoms, amide groups of up to 5 carbon atoms, alkylthio groups of up to 5 carbon atoms, alkoxy groups of up to 5 carbon atoms, alkyl groups of up to 5 carbon atoms, alkenyl groups of up to 5 carbon atoms, aryl groups of up to 10 carbon atoms and heterocyclic ring nuclei of up to 10 ring atoms selected from C, N, O, S and Se;

each of $R^{15}$ and $R^{16}$ is independently selected from the group consisting of hydrogen, tertiary amino groups, alkyl groups of up to 10 carbon atoms, aryl groups of up to 14 carbon atoms, heterocyclic ring nuclei of up to 6 ring atoms, carbocyclic ring nuclei of up to 6 carbon atoms and fused ring systems of up to 14 ring atoms, each of which groups, ring nuclei and fused ring systems may possess one or more substitutents as defined for $R^{11}$ to $R^{14}$;

$Y^{\ominus}$ is an anion;

X is selected from the group consisting of $$SO_2, \quad C{=}O \quad \text{and} \quad C{=}C\begin{matrix}CN\\CN\end{matrix} \quad ; \text{ and}$$

Z is selected from the group consisting of O, S and $NR^{10}$, where $R^{10}$ is selected from the group consisting of alkyl groups of up to 10 carbon atoms and aryl groups of up to 10 carbon atoms, and wherein each of the groups, nuclei and fused ring nuclei represented by $R^6$, $R^7$, $R^8$, $R^9$ and $R^{10}$ may possess one or more substituents.

15. The thermographic material according to claim 1 wherein the amine-sensitive dye comprises from 5 to 50% by weight of the dye-containing layer.

16. The thermographic material according to claim 1 wherein said layers are coated on a transparent support.

17. A method of producing an image comprising:

(a) providing a negative-acting thermographic material comprising a first layer comprising an amine compound having one or more amino groups and a second layer comprising an amine-sensitive dye which undergoes a visible change when in reactive association with the amine compound, and (b) image-wise exposing said material to infrared radiation.

18. The method according to claim 17 wherein the means for exposing the thermographic imaging material comprises:

(a) placing the thermographic imaging material in face-to-face contact with a substrate bearing an infrared absorbing image;

(b) uniformly exposing the thermographic imaging material and substrate to infrared radiation, and (c) separating the exposed thermographic imaging material from the substrate.

19. The method according to claim 18 wherein the infrared absorbing image comprises an ink or electrostatic toner image containing carbon.

20. The method according to claim 18 wherein the means for exposing the thermographic imaging material and substrate comprise a transparency maker.

21. The method according to claim 17 wherein said image is on an overhead projector transparency.

* * * * *